US008443886B2

(12) United States Patent
Torres et al.

(10) Patent No.: US 8,443,886 B2
(45) Date of Patent: May 21, 2013

(54) PERFORATING GUN WITH ROTATABLE CHARGE TUBE

(75) Inventors: Manuel Torres, Grand Junction, CO (US); Darwin Holte, Grand Junction, CO (US)

(73) Assignee: CCS Leasing and Rental, LLC, Grand Junction, CO (US)

( * ) Notice: Subject to any disclaimer, the term of this patent is extended or adjusted under 35 U.S.C. 154(b) by 390 days.

(21) Appl. No.: 12/955,741

(22) Filed: Nov. 29, 2010

(65) Prior Publication Data

US 2012/0037365 A1 Feb. 16, 2012

Related U.S. Application Data

(60) Provisional application No. 61/373,149, filed on Aug. 12, 2010.

(51) Int. Cl.
*E21B 43/119* (2006.01)

(52) U.S. Cl.
USPC ..... 166/297; 175/4.51; 175/4.53; 89/1.15

(58) Field of Classification Search
USPC ..... 89/1.15; 102/310; 166/297, 298, 166/55.1; 175/4.51, 4.53
See application file for complete search history.

(56) References Cited

U.S. PATENT DOCUMENTS

| | | | | |
|---|---|---|---|---|
| 4,566,544 | A | 1/1986 | Bagley et al. | |
| 4,637,478 | A * | 1/1987 | George | 175/4.51 |
| 4,693,308 | A | 9/1987 | Luke et al. | |
| 5,211,714 | A * | 5/1993 | Jordan et al. | 166/297 |
| 5,251,869 | A * | 10/1993 | Mason | 251/1.2 |
| 6,595,290 | B2 * | 7/2003 | George et al. | 166/297 |
| 6,662,883 | B2 | 12/2003 | Bonkowski | |
| 6,865,978 | B2 | 3/2005 | Kash | |
| 7,409,992 | B2 | 8/2008 | Zazovsky et al. | |
| 2009/0159283 | A1 * | 6/2009 | Fuller et al. | 166/297 |

FOREIGN PATENT DOCUMENTS

EP 0452126 B1 10/1991

* cited by examiner

*Primary Examiner* — William P Neuder
*Assistant Examiner* — Richard Alker
(74) *Attorney, Agent, or Firm* — Marsh Fischmann & Breyfogle LLP; Jonathon A. Szummy

(57) ABSTRACT

A perforating gun designed to orient a charge holding structure (e.g., tube, solid rod) within a barrel of the perforating gun to be at the same position relative to a wellbore casing regardless of a position of the barrel of the perforating gun. A charge assembly receivable within the barrel includes the charge holding structure and first and second end caps that are rotatably interconnected to the charge holding structure and non-rotatably interconnected to the barrel. As the charge holding structure is always or substantially always designed to maintain a common orientation in relation to the wellbore casing, explosive charges associated with the charge holding structure so as to fire towards particular location on the wellbore casing may always or substantially always perforate such particular locations upon or after the explosive charges have fired.

22 Claims, 11 Drawing Sheets

PERFORATING GUN WITH ROTATABLE CHARGE TUBE

RELATED APPLICATIONS

This application claims priority to U.S. Provisional Application No. 61/373,149, filed Aug. 12, 2010, entitled "PERFORATING GUN WITH ROTATABLE CHARGE TUBE", the entirety of which is hereby incorporated by reference.

FIELD

The present invention relates to a perforating gun for use in subterranean wellbores, and more particularly, to a perforating gun including a rotatable charge tube that can maintain a desired orientation of one or more charges in relation to the wellbore casing.

BACKGROUND

Wells are created in the earth's surface as part of the exploration and acquisition of petroleum oil hydrocarbons, natural gas, water, and the like. An oil or gas operator will typically create a well by drilling a hole into the earth (e.g., with a drilling rig that rotates a drill string with an attached bit) to at least a depth or location adjacent or near a reservoir or other subterranean feature (e.g., porous rocks) from which substances are to be explored and/or extracted. After the hole is drilled, sections of steel pipe (e.g., "casing") that are slightly smaller in diameter than the borehole (e.g., "wellbore") are placed in the hole. Cement or other compounds may be placed between the outside of the casing and the borehole. The casing provides structural integrity to the newly drilled wellbore, in addition to isolating potentially dangerous high pressure zones from each other and from the surface.

After drilling and casing has been completed, the well may be "completed" or otherwise enabled to produce oil or gas. Completion initially includes creating perforations (e.g., small holes) in the casing via explosive charges which allow oil or gas to pass from the reservoir or other subterranean feature into the production tubing. The explosive charges are conveyed to the intended region of the well, such as an underground strata containing hydrocarbon, by a perforating gun or perforation gun system (e.g., "gun systems," or "gun string"). For instance, a perforating gun typically consists of a barrel along with a structure holding a number of charges that may be loaded into the barrel. The perforating gun is typically conveyed through the cased wellbore by means of coiled tubing (e.g., tubing conveyed perforation or TCP), wireline (e.g., slickline), or other devices, depending on the application and service company recommendations. Completion may also include pumping acids and fracturing fluids into the well to fracture, clean, or otherwise prepare and stimulate the reservoir rock to optimally produce hydrocarbons into the wellbore and/or packing off the area above the reservoir section inside the casing and connecting this section to the surface via a smaller diameter pipe called tubing. After the completion stage, oil and gas may be produced from the well.

SUMMARY

One difficulty encountered in perforating a wellbore casing is ensuring that a desired circumferential location (e.g., a particular phase angle) on the interior surface of the casing or other surface surrounding the wellbore is perforated. Desired circumferential locations often coincide with particular fracture planes in the rock structure surrounding the wellbore. For instance, in the case of horizontal wellbores, perforating or puncturing the casing at a 0° and/or 180° phase (i.e., at the top and/or bottom of the wellbore) is advantageous as doing so may show more open perforations during the fracing process. Service companies and providers currently utilize finned subs, tubing swivels, locking nuts and/or other devices in an attempt to maintain the perforating gun at a particular orientation with respect to a desired circumferential location on the wellbore casing once the perforating gun has reached a desired depth in the wellbore. However, these arrangements unnecessarily increase the length and mass of perforating gun systems and are limited in their ability to allow the perforating gun to perforate a desired location or phase angle on the wellbore casing. Moreover, the increased number of swivels and finned subs that occurs within increasing overall length of the perforating gun only increases the difficulty that such systems have in maintaining a desired location or phase angle in relation to the wellbore casing.

In this regard, the inventors have determined that it would be beneficial to have a perforating gun or system that is designed to allow charges that are mounted within or relative to the perforating gun to fire towards and contact a desired circumferential location (e.g., phase angle) on an interior surface of the wellbore casing regardless of a position of the barrel of the perforating gun. Stated otherwise, it would be advantageous for the gun to "automatically" orient a charge holding structure (e.g., tube, solid rod) within a barrel of the perforating gun and/or the charges themselves to be at the same position relative to the wellbore casing regardless of the position of the barrel. Even as the barrel of such a perforating gun may twist or rotate as the gun is fed or otherwise conveyed down a wellbore, the charge holding structure and/or charges would maintain the same orientation (e.g., the "top" of the charge holding structure continues to face the "top" of the wellbore casing). Thus, charges that are mounted on or within the charge holding structure so as to fire or explode in a particular direction or along a particular path from the charge holding structure towards the wellbore casing would advantageously maintain the particular direction or path even after the gun has been lowered into a wellbore that changes course numerous times and/or after the barrel has changed orientation.

For instance, when charges are mounted on or within the charge holding structure so as to fire directly away from the top of the charge holding structure (e.g., perpendicularly from the top of the charge holding structure), such charges may continue to fire directly towards the top of the wellbore casing (e.g., at a 0° phase angle). Similarly, charges mounted to fire at other angles from the charge holding structure towards the wellbore casing (e.g., towards 90°, 180°, 270° and/or other phase angles on the interior surface of the wellbore casing) may maintain such orientations once the gun has been lowered to a desired depth or longitudinal position in the wellbore. In this regard, the use of external devices (e.g., finned subs, swivels, etc.) that attempt to maintain desired orientations of the gun within the wellbore and the above-discussed problems associated therewith can be avoided.

According to a first aspect, an apparatus for use in perforating a wellbore casing is provided. The apparatus includes a tubular housing including first and second ends and an internal cavity between the first and second ends that is adapted to contain at least one perforating charge. First and second end caps are respectively positionable generally adjacent the first and second ends of the tubular housing, first and second substantially straight reference lines are defined along an outer surface of the tubular housing that extend between the first and second end caps, and a reference plane extends through the first and second reference lines. In this aspect, the first and second end caps are respectively interconnectable to the first and second ends of the tubular housing such that the reference plane remains in a desired orientation regardless of an orientation of either of the first and second end caps when the apparatus is disposed in a wellbore. Upon selecting a desired orientation of the reference plane (e.g., an up/down or vertical orientation of the reference plane), operators can arrange charges within the tubular housing so as to fire along a path coinciding with the reference plane so that the charges are directed at the top of the wellbore casing (i.e., at a 0° phase angle) and/or the bottom of the wellbore casing (i.e., at a 180° phase angle) regardless of how one or both of the end caps are positioned. Charges may also be oriented to fire along other paths or directions (i.e., at other phase angles between 0° and 360°) by orienting the charges in the tubular housing relative to (e.g., in directions transverse to) the reference plane.

According to another aspect, a charge assembly for use in perforating a casing of a wellbore that passes through a subterranean formation is disclosed. The charge assembly includes a charge holding structure including first and second ends, a charge mounted to the charge holding structure so as to fire away from the charge holding structure in a first direction relative to the charge holding structure, a first end cap that is rotatably interconnected to the first end of the charge holding structure, and a second end cap that is rotatably interconnected to the second end of the charge holding structure. In this aspect, the charge holding structure orients the first direction towards a particular circumferential location on an inside surface of a wellbore casing regardless of an orientation of the first and second end caps.

According to another aspect, a perforating gun is disclosed including a tubular barrel including a first end, a second end, and an internal cavity extending between the first and second ends, and a charge assembly disposed within the internal cavity of the tubular barrel. The charge assembly includes a first end cap that is non-rotatably interconnected to the tubular barrel, a second end cap that is non-rotatably interconnected to the tubular barrel, and a charge holding structure that is rotatably interconnected to the first end cap and the second end cap.

In another aspect, a method for use in perforating a casing of a wellbore that passes through a subterranean formation includes selecting a desired circumferential location on the wellbore casing to be perforated, sending a perforating gun into the wellbore from an entry point to a desired longitudinal location with respect to a length of the wellbore, where the perforating gun includes a tubular barrel and a charge holding structure with at least one explosive charge disposed within the tubular barrel, and perforating the wellbore casing at the desired circumferential location using the at least one charge regardless of an orientation of the tubular barrel of the perforating gun.

Any of the embodiments, arrangements, and the like discussed herein may be used (either alone or in combination with other embodiments, arrangement, and the like) with any of the disclosed aspects. Any feature disclosed herein that is intended to be limited to a "singular" context or the like will be clearly set forth herein by terms such as "only," "single," "limited to," or the like. Merely introducing a feature in accordance with commonly accepted antecedent basis practice does not limit the corresponding feature to the singular (e.g., indicating that the charge holding structure includes "an explosive charge" does not necessarily mean that the charge holding structure includes only a single explosive charge). Moreover, any failure to use phrases such as "at least one" also does not limit the corresponding feature to the singular (e.g., indicating that a charge holding structure includes "an explosive charge" alone does not mean that the charge holding structure includes only a single explosive charge). Use of the phrase "generally," "at least generally," "substantially," "at least substantially" or the like in relation to a particular feature encompasses the corresponding characteristic and insubstantial variations thereof (e.g., indicating that the explosive charge "substantially always" fires towards the 0° phase angle encompasses the explosive charge always firing at the 0° phase angle). Finally, a reference of a feature in conjunction with the phrase "in one embodiment" or the like does not limit the use of the feature to a single embodiment.

DETAILED DESCRIPTION

Reference will now be made to the accompanying drawings, which assist in illustrating the various pertinent features of the various novel aspects of the present disclosure. While the perforating gun and the various components thereof (e.g., charge assembly) will be described primarily in relation to perforating casings and/or inner walls of wellbores for access to fluids (e.g., oil, natural gas, water), these mechanisms (and associated methods, systems, etc.) may also be used in other environments where it would be useful to perforate surfaces at numerous desired circumferential locations about the surface. In this regard, the following description is presented for purposes of illustration and description. Furthermore, the description is not intended to limit the inventive aspects to the forms disclosed herein. Consequently, variations and modifications commensurate with the following teachings, and skill and knowledge of the relevant art, are within the scope of the present inventive aspects.

Figure 1:
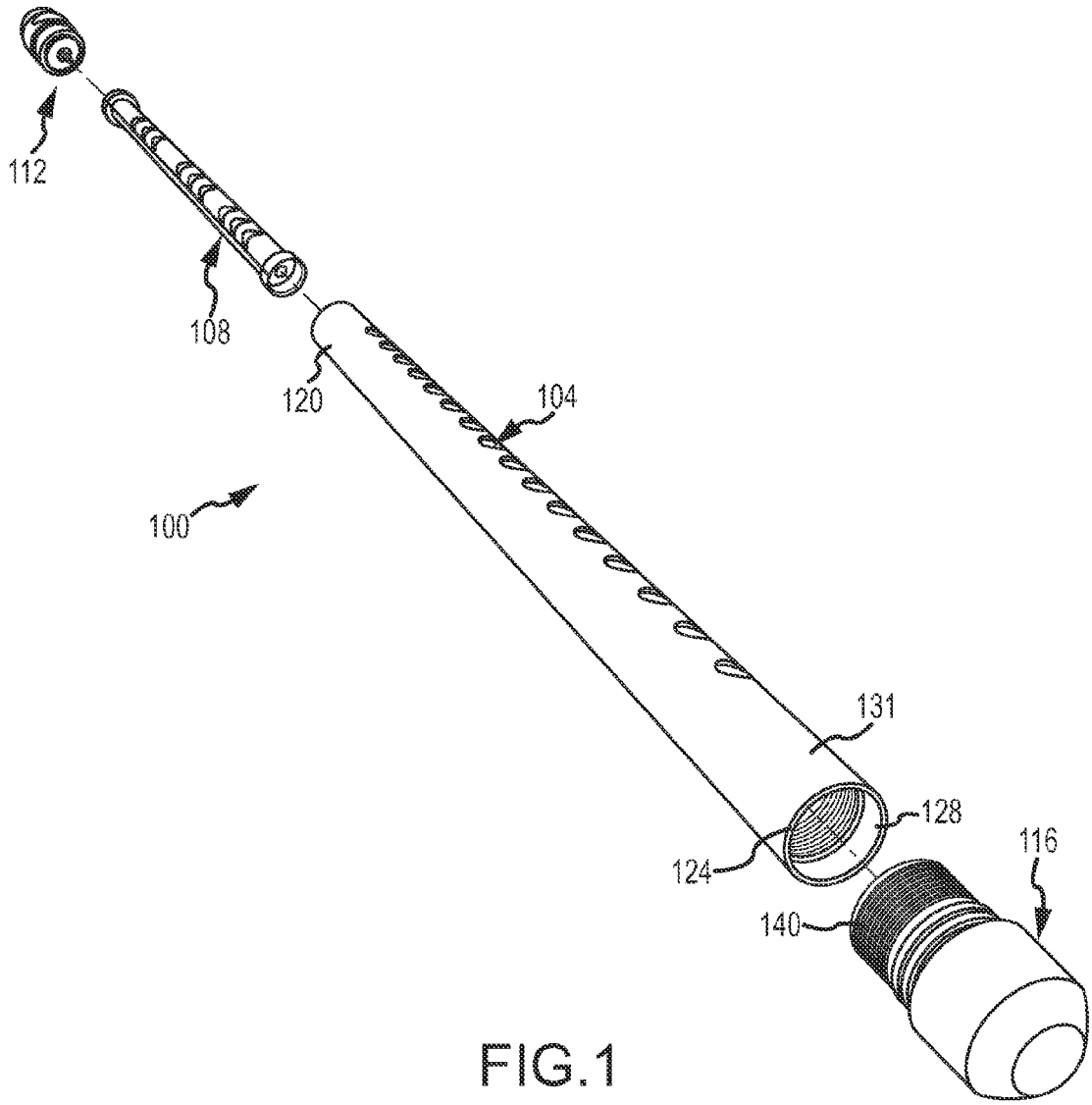
FIG. 1 illustrates an exploded perspective view of a perforating gun according to one embodiment.

FIG. 1 illustrates an exploded perspective view of a perforating gun 100 according to one embodiment that may be lowered or conveyed into a well or wellbore in any appropriate manner (e.g., tubing conveyed, wireline, slickline) to perforate the wellbore casing and/or interior wall or surface and allow oil, natural gas, water and the like to be obtained via the resulting perforations. It is noted that the perforating gun 100 may also be referred to herein as a "perforating gun portion". For instance, a number of perforating gun portions may be appropriately interconnected via subs (e.g., screw-on threaded connectors, described more fully below) or other connection mechanisms to obtain a "perforating gun" in the case where a longer perforating gun is desired and/or where an operator wants the ability to selectively ignite successive perforating gun portions at different times. For instance, in the case where an overall length of 20 feet for a perforating gun is desired, a single perforating gun portion of 20 feet could be constructed or multiple perforating gun portions (e.g., four portions of five feet each) could be utilized. Other arrangements are also encompassed within the present disclosure. In any event, the perforating gun 100 may broadly include a tubular barrel 104, a charge assembly 108, and first and second subs 112, 116 (e.g., tubular subs, connecting subs).

The tubular barrel 104 may be constructed of any appropriate material (e.g., steel with any appropriate alloy(s)) and may include a housing 118, first and second ends 120, 124, and at least one internal cavity 128 between the first and second ends 120, 124 for receiving the charge assembly 108 as will be described more fully below. While an outer surface 131 of the housing 118 is shown in FIG. 1 as including a series of holes (not labeled) therein, in other arrangements such holes may not be present before the perforating gun has been fired and holes may be formed upon explosive charges firing from the charge holding structure 108 through the housing 118 and into the wellbore casing. In one arrangement, the interior surface of the tubular barrel 104 may include a scallop layer between the first and second ends 120, 124 to limit deformation of the tubular barrel 104 towards a wellbore casing upon the firing of explosive charges.

Figure 2:
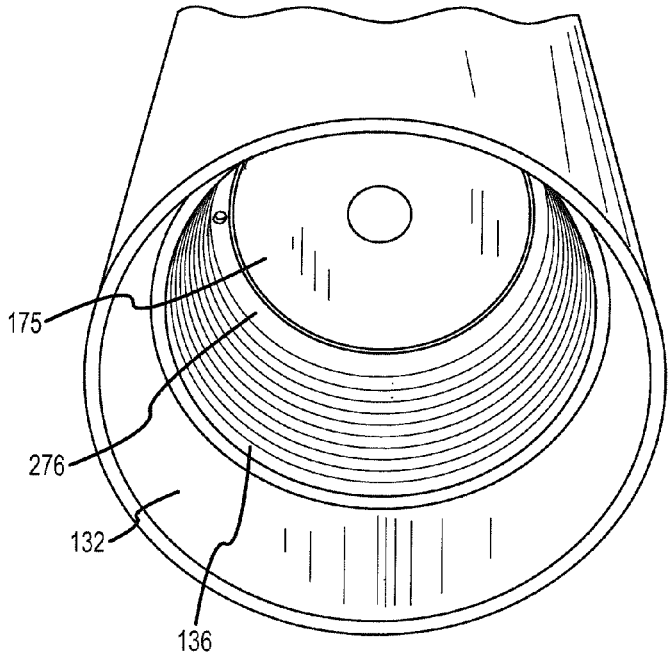
FIG. 2 illustrates a perspective view of one end of a tubular barrel of the perforating gun of FIG. 1, and showing an end cap of a charge assembly within the tubular barrel.
Figure 3:
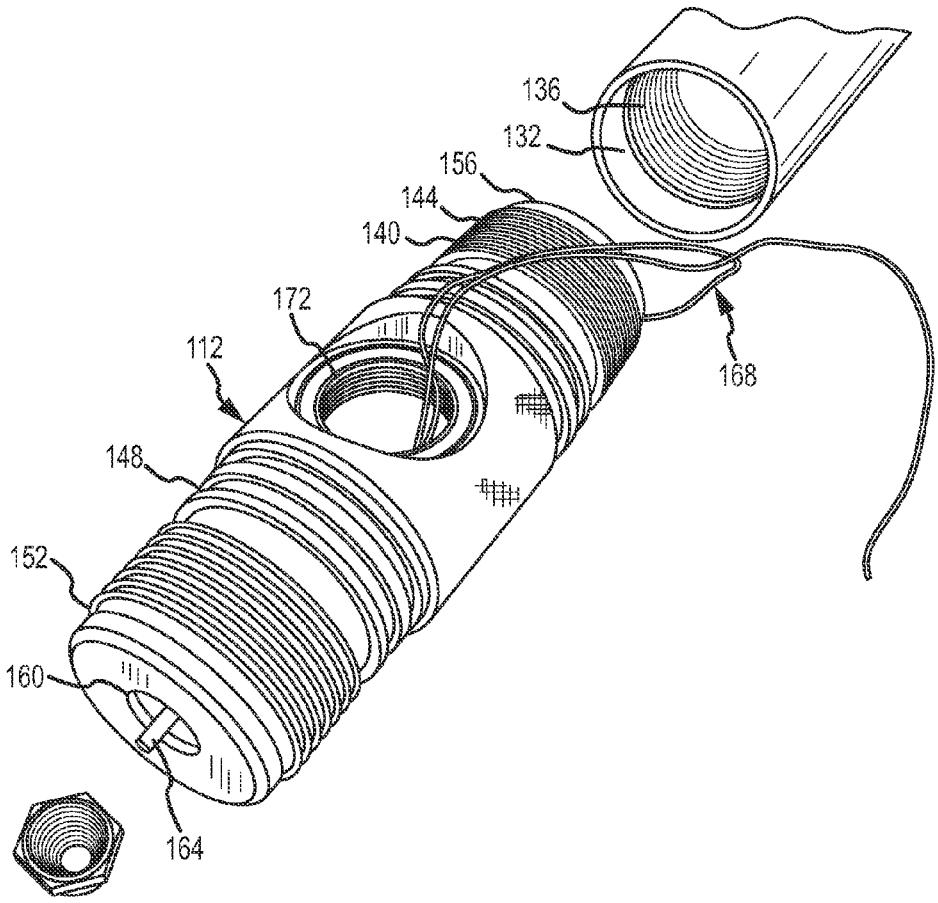
FIG. 3 illustrates a perspective view of another end of the tubular barrel and a connecting sub of FIG. 1.

With reference now to FIGS. 1-3, the first and second ends 120, 124 of the tubular barrel 104 may be constructed to respectively interact with (e.g., receive) the first and second subs 112, 116 to seal or close off the internal cavity 128 and the charge assembly thereinside. While the first sub 112 is in the form of a "connecting sub" that is operable to allow another perforating gun portion to be connected to the first end 120 of the perforating gun portion 100 shown in FIG. 1 and the second sub 116 is in the form of an "end sub" that limits additional perforating gun portions from being connected to the second end 124, any combination of connecting subs and end subs may be connected to the first and second ends 120, 124 of the perforating gun 100 shown in FIG. 1 depending upon specific design requirements of a particular wellbore.

As shown, an inside surface 132 of the housing 118 of the tubular barrel 104 near the first and second ends 120, 124 may include a first engagement structure 136 (e.g., a threaded surface), and an outer surface 140 of the first and second subs 112, 116 may include a corresponding second engagement structure 144 (e.g. threaded surface) that is adapted to interact or engage with the first engagement structure 136. In this regard, the first and second subs 112, 116 can be respectively screwed or threaded into the first and second ends 120, 124 of the tubular barrel 104 to at least partially close off the internal cavity 128. Of course, other arrangements are also envisioned such as at least one of the first and second ends 120, 124 of the tubular barrel 104 being inserted within one of the first and second subs 112, 116 with the use of detents, snap features, and or threaded fasteners in place of the threaded surfaces, etc.

With continued reference to FIG. 3, the first sub 112 may include a housing 148 having the outer surface 140, first and second ends 152, 156, and a first internal cavity 160 between the first and second ends 152, 156. The first internal cavity 160 may include or receive any appropriate componentry as known in the art to allow for the firing of charges in respective perforating gun 100 portions depending upon the specific manner of perforation being used (e.g., wireline, tubing conveyed). For instance, a switch 164, wiring 168, an igniter or booster (not shown), and/or primer cord (not shown), etc. may be disposed in the first internal cavity 160 and appropriately interconnected to successive perforating gun portions to fire the explosive charges of respective perforating gun portions. The first sub 112 may also include a second internal cavity 172 that intersects the first internal cavity 160 and may allow access to componentry contained within the first internal cavity 160. A cap or cover (not shown) may be appropriately interconnected with the housing 148 of the first sub 112 (e.g., via a threaded connection) to close or seal off the second internal cavity 172.

Turning now to FIGS. 1, 2, 4 and 5, the charge assembly 108 broadly includes a first end plate or cap 174, a second end plate or cap 175, and a charge holding structure 176 that is rotatably interconnected to the first and second end caps 174, 175. The charge assembly 108 is designed such that the charge holding structure 176 orients itself in the same or substantially the same direction at substantially all times with respect to the surface of a wellbore casing or other internal surface regardless of an orientation of the first end cap 174, second end cap 175, and/or tubular barrel 104. As a result, charges mounted on or in association with the charge holding structure 176 so as to fire in a particular direction away from the charge holding structure 176 may upon or after firing make contact with the same corresponding location on an interior surface of the wellbore casing even if the tubular barrel 104 shifts, twists, etc. during the trip through the wellbore to the desired location to be perforated. While the ensuing discussion will include at least one "reference plane" defined through the charge holding structure 176 that may remain coincident or substantially coincident with a vertical plane (e.g., so that charges mounted on such reference plane may fire at a 0° phase angle in relation to the wellbore casing), numerous other reference planes may additionally be defined that remain in other particular orientations without departing from the spirit of the present disclosure.

The charge holding structure 176 may be in any appropriate form (e.g., solid rod or bar, hollow structure, combinations thereof) and is operable to hold or support at least one explosive charge 180 (e.g., a plurality of explosive charges) that when ignited can perforate a wellbore casing. As shown, the charge holding structure 176 may be in the form of a tubular housing 184 or any appropriate cross section (e.g., circular, non-circular) including a first end 188 that is rotatably interconnected to the first end cap 174 and a second end 192 that is rotatably interconnected to the second end cap 175 as will be discussed in more detail below. It is noted that the various components discussed herein that are "connected to," "interconnected to," etc. another component may also be "connectable to," "interconnectable to," etc. such other respective components (signifying that such components need only be capable of being connected or interconnected to the respective components and in this regard may be included as part of a "kit" in which the components may in some instances not be actually connected or interconnected to such respective components). For instance, a kit may include any of the charge assemblies or related componentry discussed herein and/or a tubular barrel.

Figure 6:
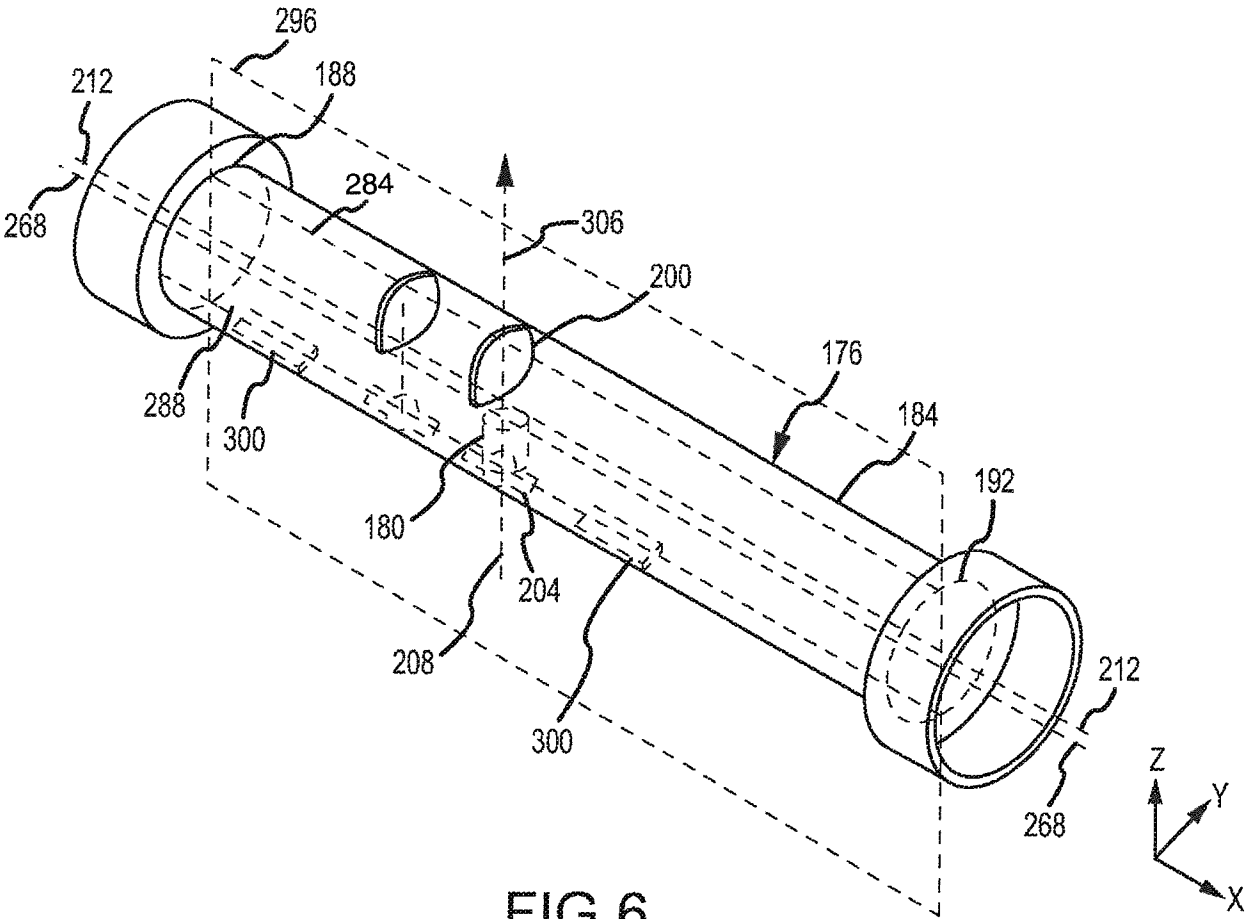
FIG. 6 illustrates a perspective view of the charge assembly of FIGS. 4-5 including various reference lines and reference planes, and some features have been removed for clarity.

The tubular housing 184 may include at least one internal cavity 196 between the first and second ends 188, 192 that is operable to receive the at least one explosive charge 180, other explosive component(s) (e.g., detonating cord, primer cord), and/or the like. In some arrangements, the internal cavity 196 may be appropriately divided up or parceled into multiple cavities to hold various portions or groups of explosive charges 180 or other devices. The tubular housing 184 may also include one or more openings or bores extending therethrough such as at least one first charge opening 200 and/or at least one second charge opening 204. As seen in FIG. 6, the at least one second charge opening 204 may be designed to receive at least a portion of an explosive charge 180 for mounting of the explosive charge 180 within the internal cavity 196 (e.g., via clips or other attachment mechanisms). For instance, primer cord (not shown) may be appropriately threaded through or relative to a portion of the explosive charge 180 which may function to tie down the explosive charge 180 over or within the at least one second charge opening 204. Of course, the explosive charges 180 need not be mounted within an opening such as the at least one second charge opening 204 and may instead be merely mounted entirely on an interior surface of the tubular housing 184.

In any event, the at least one first charge opening 200 may be designed and of such a size to receive an explosive charge 180 or otherwise allow an explosive charge 180 to exit the tubular housing 184 and upon firing make contact with an interior surface of the tubular barrel 104 and/or the wellbore casing. In one arrangement, each respective first and second charge opening 200, 204 may be located directly over one another such that an axis 208 passing through the centers of each of the respective first and second charge openings 200, 204 is substantially perpendicular to a rotational axis 212 of the tubular housing 184 relative to the first and second end caps 174, 175. This arrangement advantageously allows an operator to mount the explosive charge 180 essentially flat over a second charge opening 204 such that the explosive charge is oriented to fire directly upwards in relation to the internal cavity 196 of the tubular housing 184. Other arrangements of first charge openings 200 relative to second charge openings 204 are also contemplated.

Figure 4:
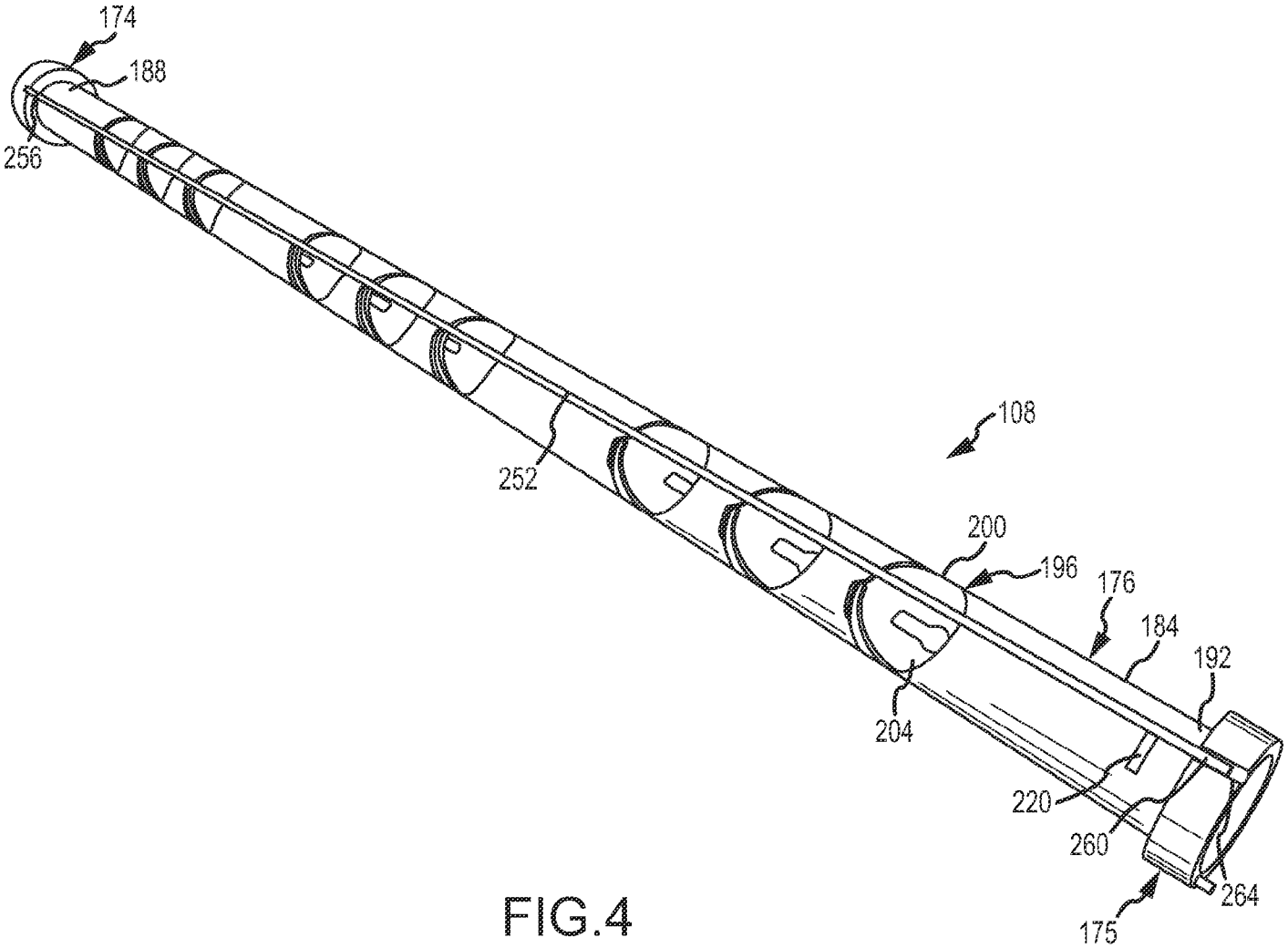
FIG. 4 illustrates a perspective view of a charge assembly receivable within the tubular barrel of FIG. 1, and showing a top portion of a charge holding structure of the charge assembly.

The first and second charge openings 200, 204 may also be distributed along the tubular housing 184 according to any desired shot density or spacing. In one arrangement, three first charge openings 200 (and/or second charge openings 204) may be included in each one foot of tubular housing 184 length (i.e., along a longitudinal portion of the tubular housing 184), and the charges of a first foot of the tubular housing 184 may be spaced from the charges of a second foot of the tubular housing 184 as seen in FIG. 4. Operators, service providers and other technicians can readily specify a desired shot density and direction for a particular wellbore casing perforation depending upon the material and structure of the surrounding subterranean formation, type of hydrocarbon or other resource being extracted, depth of the perforation location, etc.

As discussed previously, the charge holding structure 176 is operable to "automatically" adjust or otherwise reorient itself so that a particular portion of the charge holding structure 176 may be positioned towards the same or substantially same corresponding circumferential location on the wellbore casing even as the first end cap 174, second end cap 175, and/or tubular barrel 104 move between various different orientations. To this end, the charge holding structure 176 is rotatable relative to the first and second end caps 174, 175 about the rotatable axis 212 (see FIG. 6).

Figure 7:
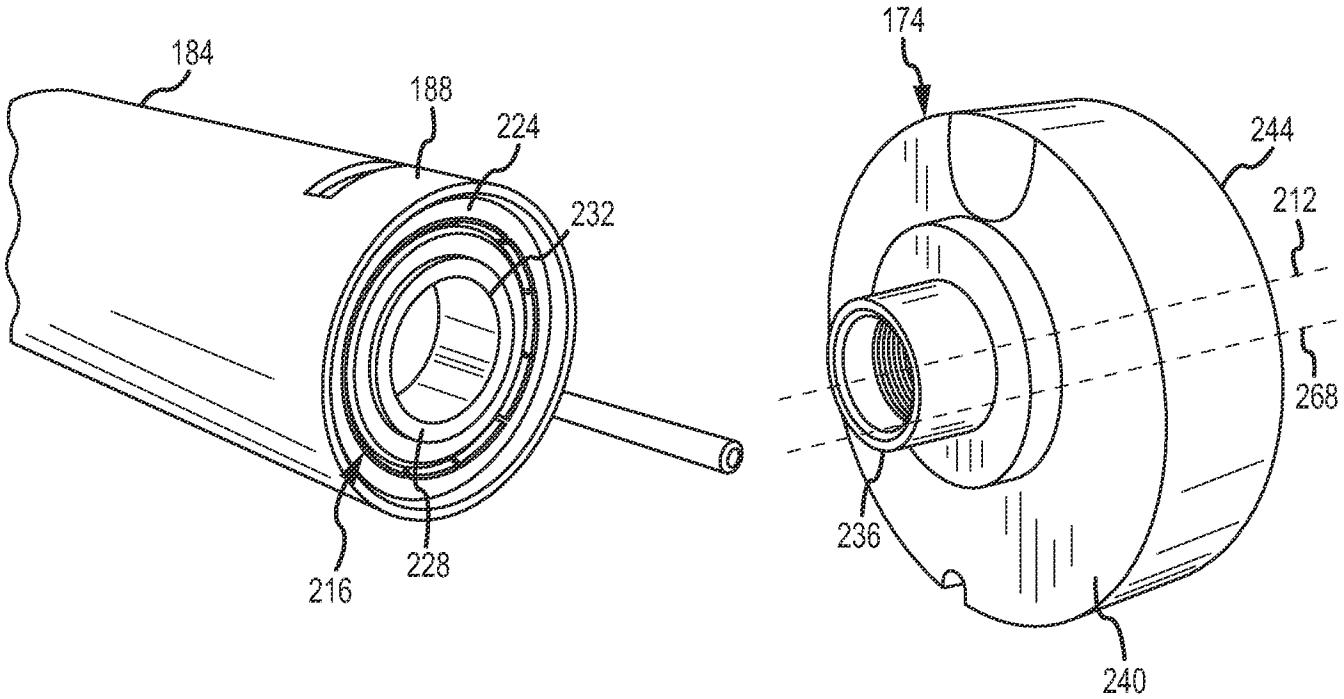
FIG. 7 illustrates an exploded perspective view of one end of the charge assembly of FIGS. 4-5 and showing a bearing assembly received within one end of the charge holding structure.

Turning now to FIG. 7, an exploded perspective view is shown of the first end 188 of the tubular housing 184 and the first end cap 174. A similar discussion may also apply to the second end 192 of the tubular housing 184 and the second end cap 175, and thus, such similar discussion will not be included herein. In any event, a first bearing structure 216 may be positioned generally adjacent the first end 188 so as to rotatably interconnect the first end 188 and the first end cap 174. In one arrangement, the first bearing structure 216 may be disposed within the internal cavity 196 of the tubular housing 184 in any appropriate manner. For instance, the first bearing structure 216 may be sized to be press-fit within the internal cavity 196 (e.g., an outer diameter of the first bearing structure 216 may be about the same or slightly smaller than an inner diameter of the tubular housing 184). To limit the first bearing structure 216 from migrating to an undesired location within the internal cavity 196, at least one protrusion 220 (not labeled in FIG. 7, but see FIG. 5) may be formed or disposed within the internal cavity 196 so as to extend away from an interior surface of the tubular housing 184. For instance, the protrusion 220 may be in the form of a cutout or punched portion in the tubular housing 184 so as to protrude a portion of the tubular housing 184 into the internal cavity 196 and limit the bearing structure 216 from sliding past the protrusion 220.

Broadly, the first bearing structure 216 may include a first portion 224 that is rotatably or otherwise movably connected to a second portion 228, where the first portion 224 is for non-movable contact with the tubular housing and the second portion 228 is for non-movable contact with the first end cap 174. In the case of the first portion 224, the press-fit nature of the first bearing structure 216 relative to the tubular housing 184 may result in sufficient friction to limit rotation between the first portion 224 and the tubular housing 184. In some arrangements, adhesives, key and groove arrangements, and/or the like may be utilized to limit rotation between the first portion 224 and the tubular housing 184. Similarly, the second portion 228 may be interconnected with the first end cap 174 in any appropriate manner. For instance, the first bearing structure 216 may include a bore 232 extending between first and second opposing surfaces thereof (not labeled) which may receive a stub 236 extending away from a first side 240 of first and second opposing surfaces or sides 240, 244 of the first end cap 174. In one arrangement, the stub 236 may be press-fit into the bore 232 and may become non-rotatable relative to the second portion 228 of the first bearing structure 216 as a result. Although not readily visible from the figures, it may be desirable that a space or gap (not labeled) exists between the first side 240 of the first bearing structure 216 and a free end (not labeled) of the first end 188 of the tubular housing 184 (or of the charge holding structure in general). Doing so may reduce the chances for binding and in other words allow for free rotation between the end caps and the charge holding structure 176. For instance, it has been found that gaps such as between 1/16" to 1/4" may allow for such free rotation while sufficiently maintaining the structural integrity of the charge assembly 108.

Other manners of securing the first end cap 174 to the second portion 228 are also envisioned and encompassed herein. In another arrangement, the first end 188 of the tubular housing 184 may include a stub or other feature that is operable to be inserted into a bearing arrangement disposed on or within the first end cap 174. For instance, a bearing arrangement may be disposed about an outer surface (not labeled) of the charge holding structure 176 or tubular housing 184 to allow for rotation between an end cap and the charge holding structure 176.

Figure 8:
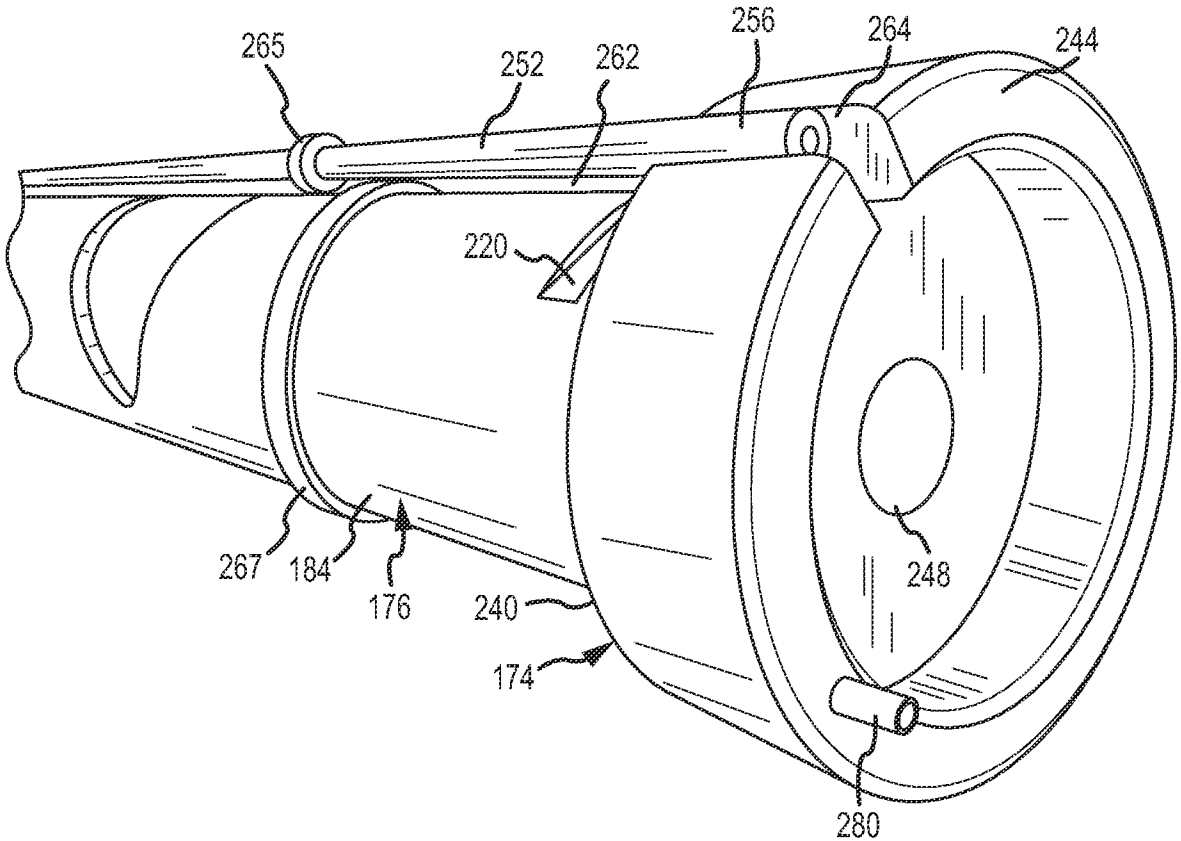
FIG. 8 illustrates a view similar to FIG. 7, but with the end cap being rotatably interconnected to the charge holding structure.

With reference now to FIGS. 7 and 8, the first end cap 174 may also include a bore 248 extending therethrough from the first side 240 to the second side 244. The bore 248 of the first end cap 174 may be generally alignable with the bore 232 of the first bearing structure 216 upon inserting the stub 236 into the bore 232. This arrangement may allow the passage of wiring, cords, tubes and the like to be passed between the internal cavity 196 of the tubular housing 184 and an exterior of the first end cap 174 (and eventually to another perforating gun portion as will be discussed in more detail below).

Figure 5:
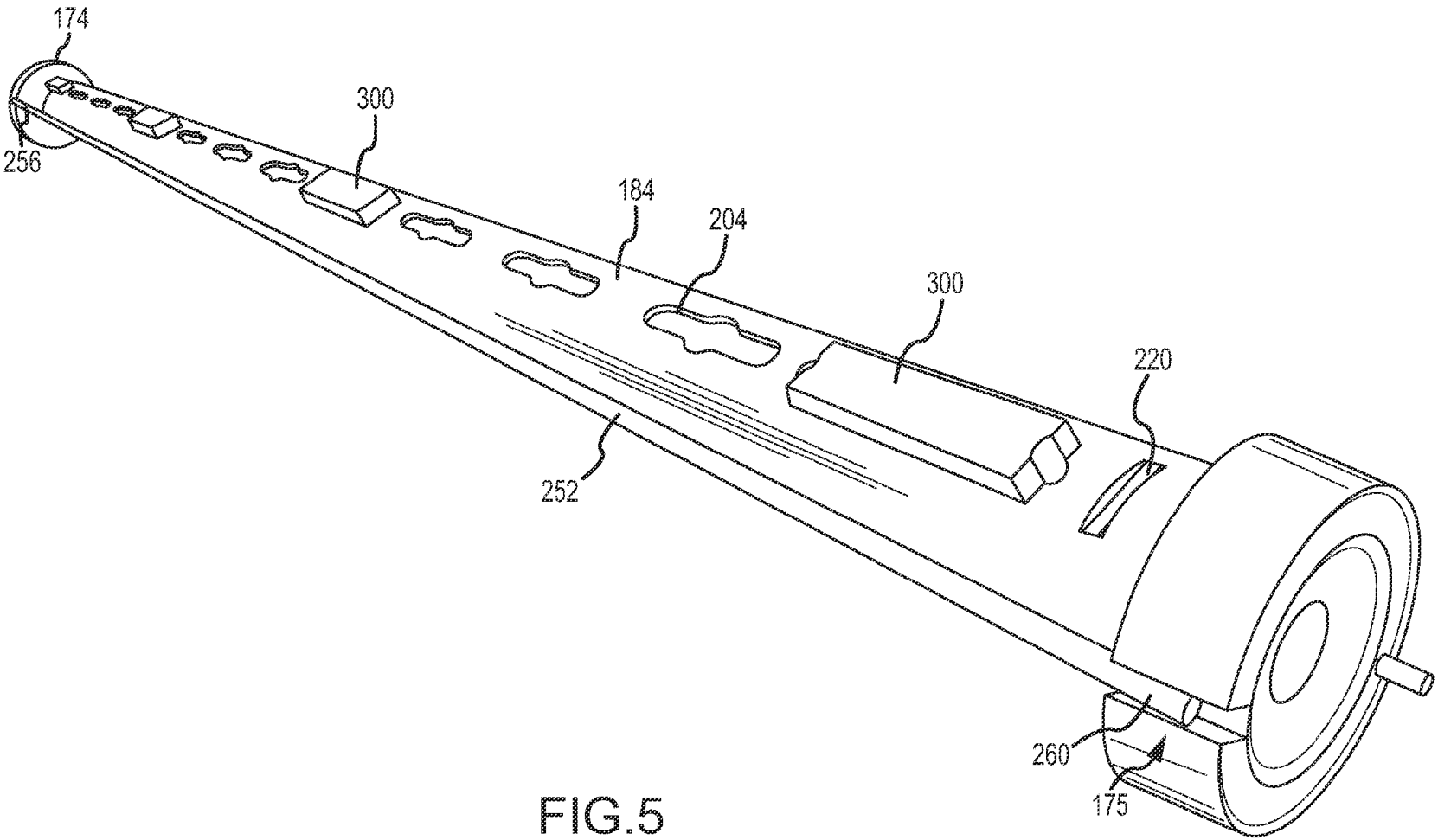
FIG. 5 illustrates a perspective view of the charge assembly similar to FIG. 4, but illustrating a bottom view of the charge holding structure.

Referring now to FIGS. 4, 5 and 8, the charge assembly 108 may also include at least one conveying feature or wiring path such as a wiring tube 252. Broadly, the wiring tube 252 is operable to convey wiring (e.g., hot wires) and the like between the first and second ends 188, 192 of the tubular housing 184 while limiting the wiring tube 252 (and any wiring thereinside) from rotating or turning with the tubular housing 184 and thus limiting wiring within the wiring tube 252 from twisting or becoming tangled. For instance, first and second ends 256, 260 of the wiring tube 252 may be respectively non-rotatably interconnected to the first and second end caps 174, 175 such that a gap 262 exists between the wiring tube 252 and the tubular housing 184 (see FIG. 8). This arrangement advantageously limits any such wiring from restricting the substantially free rotational movement of the tubular housing 184 in relation to the first and second end caps 174, 175. As shown, each of the first and second end caps 174, 175 may include a depression 264 that is sized to allow the first and second ends 256, 260 of the wiring tube 252 to be respectively press-fit therein. Of course, other manners of interconnecting the wiring tube 252 to the first and second end caps 174, 175 are envisioned as well as the use of additional wiring tubes 252.

Numerous manners of increasing the size of the gap 262 or otherwise limiting binding or catching between the wiring tube 252 and the tubular housing 184 are envisioned. In one arrangement, one or more spacers or rings 265 may be included as part of the charge holding structure 176 and disposed at least partially between the wiring tube 252 and the tubular housing 184 to space the wiring tube 252 from the tubular housing 184 and limit binding between the same. For instance, the rings 265 may be intersected by or mounted about the wiring tube 252 (e.g., rigidly, rotatably). Additionally or alternatively, one or more spacers or rings 267 may be mounted (e.g. rigidly, rotatably) about the tubular housing 184 to space the wiring tube 252 from the tubular housing 184. In either case, rings 265 and/or 267 may be spaced along the charge holding structure 176 to limit binding between the wiring tube 252 and the tubular housing 184 as appropriate (e.g., every 3 feet, every 5 feet).

In another arrangement, the outer diameter of the first and second end caps 174, 175 may be increased to further space the wiring tube 252 from the tubular housing (as long as the first and second end caps 174, 175 can still be inserted into the tubular barrel 104 as will be discussed in more detail below). In a further arrangement, the tubular housing 184 may be eccentrically interconnected to the first and second end caps 174, 175. That is, and with reference to FIGS. 6-8 (the wiring tube 252 and depressions 264 are not shown in FIG. 6 for clarity), the rotational axis 212 of the tubular housing 184 may be offset from a central axis 268 of each of the first and second end caps 174, 175. By positioning the depressions 264 (or other feature designed to hold the first or second ends 256, 260 of the wiring tube 252) on the first and second end caps 174, 175 on an opposite side of the central axes 268 from the rotational axis 212, the tubular housing 184 can advantageously be positioned at an increased distance from the wiring tube 252 thus increasing the size of the gap 262.

In another arrangement, the wiring path may be in the form of an elongated channel 272 (see FIGS. 9-10) formed on the interior surface 132 of the tubular barrel 104 for containing or receiving wiring, tubing, cables and/or the like. Similar to the wiring tube 252, this arrangement may limit such wiring or tubing from rotating with the tubular housing 184. Although the first and second end caps 174, 175 have been described as each having a central axis 268, this does not necessarily imply that the central axis 268 of the first end cap 174 is always coincident with the central axis 268 of the second end cap 175. In fact, as each of the first and second end caps 174, 175 may be able to rotate independently of the other of the first and second end caps 174, 175, the central axes 268 of the first and second end caps 174, 175 may become noncoincident or otherwise spaced from each other. In one arrangement, any appropriate stop or limiting arrangement may be associated with one or both of the first and second end caps 174, 175 to limit rotation of the first end cap 174 relative to the second end cap 175. For instance, corresponding pins and grooves could be disposed on the first and second end caps 174, 175 and bearing members and/or tubular housing 184 to limit the rotation of each to within a particular range. Providing stop or limiting members may be useful, for instance, to inhibit one of the first and second end caps 174, 175 from "overtwisting" relative to the other when the wiring tube 252 is attached to both of the first and second end caps 174, 175 and thereby limit binding of and/or damage to the wiring tube 252 (e.g., before the charge assembly 108 is mounted within the tubular barrel 104). In another arrangement, the stop or limiting arrangement may be operable to selectively prevent (or at least substantially prevent) movement of an end cap relative to the tubular housing 184. For instance, respective holes or bores may be defined through the end caps and the bearing assemblies and/or tubular housing 184 that may be aligned and that may receive a pin or the like to limit rotation of the end caps relative to the tubular housing 184. This feature may be useful during transport of the charge assembly 108. Numerous other arrangements are envisioned.

Turning now to FIGS. 1-2, insertion of the charge assembly 108 into the internal cavity 128 of the tubular barrel 104 will now be described. With particular reference to FIG. 2, a locking structure or ring 276 (or other feature or mechanism designed to limit sliding of the charge assembly 108 along a length of the tubular barrel 104) may initially be appropriately disposed within the internal cavity 128 near or adjacent one of the first or second ends 120, 124 of the tubular barrel. The locking ring 276 may be designed to snap or lock into place in the internal cavity 128 with respect to the interior surface 132, and the interior surface 132 may include any appropriate feature(s) (e.g., ridges, openings) that interact with the locking ring 276 to limit movement of the locking ring 276 at least along the length of the tubular barrel. Once one locking ring 276 has been appropriately mounted within the internal cavity 128 near one end of the tubular barrel 104 as discussed above, the charge assembly 108 may be inserted or loaded into the internal cavity 128 via the other end of the tubular barrel 104 until one of the first and second end caps 174, 175 abuts or nearly abuts the locking ring 276.

Before loading the charge assembly 108 into the internal cavity 128 of the tubular barrel 104, it may be useful to load the charge assembly 108 with explosive charges 180 and other componentry (e.g., wiring, primer cord, boosters). For instance, and with reference to FIG. 8, one end of a length of primer cord (e.g., detonating cord, not shown) may be slid through the bore 248 in the first end cap 174 (or second end cap 175) and into the internal cavity 196 of the tubular housing 184 towards an opposing end of the tubular housing 184. Thereafter, any appropriate booster (e.g., bi-directional booster, not shown) may be crimped onto the other end of the primer cord, and then the booster and other end of the primer cord may be slid into a booster transfer tube so as to be flush with an end of the booster transfer tube. After the booster transfer tube has been appropriately threaded or otherwise inserted into the bore 248 (which may include a threaded interior surface), explosive charges 180 may be loaded into the tubular housing 184 and appropriately interconnected with the primer cord. Additionally, a hot wire (not shown) may be appropriately threaded into the wiring tube 252 for the passage of current between successive perforating gun portions.

Turning to FIG. 8, each of the first and second end caps 174, 175 may include a first engagement structure 280 (e.g., peg) and each of the locking rings 276 may include a second engagement structure (e.g., hole, not shown) that is adapted to receive or otherwise interact with the first engagement structure 280 such that the first and second engagement structures become non-rotatable relative to each other when in engagement. In this regard, the first and second end caps 174, 175, locking rings 276 and tubular barrel 104 may all be in non-rotatable relation to each other, while the tubular housing 184 may be free or substantially free to rotate relative to the first and second end caps 174, 175, locking rings 276 and tubular barrel 104 for reasons as will be discussed below. In any event, and upon inserting one of the first and second end caps 174, 175 of the charge assembly into the internal cavity 128 of the tubular barrel 104 so as to abut one of the locking rings 276, another locking ring 276 may be inserted into the internal cavity 128 of the tubular barrel 104 so as to abut or substantially abut the other of the first and second end caps 174, 175. In one arrangement, the tubular barrel 104 may be of a length such that a portion of the internal cavity 128 near one of the first or second ends 120, 124 of the tubular barrel 104 (e.g., 1 foot) is free of the charge assembly 108 so as to allow for collection of excess componentry (e.g., primer cord) extending from the charge assembly 108.

Figure 9:
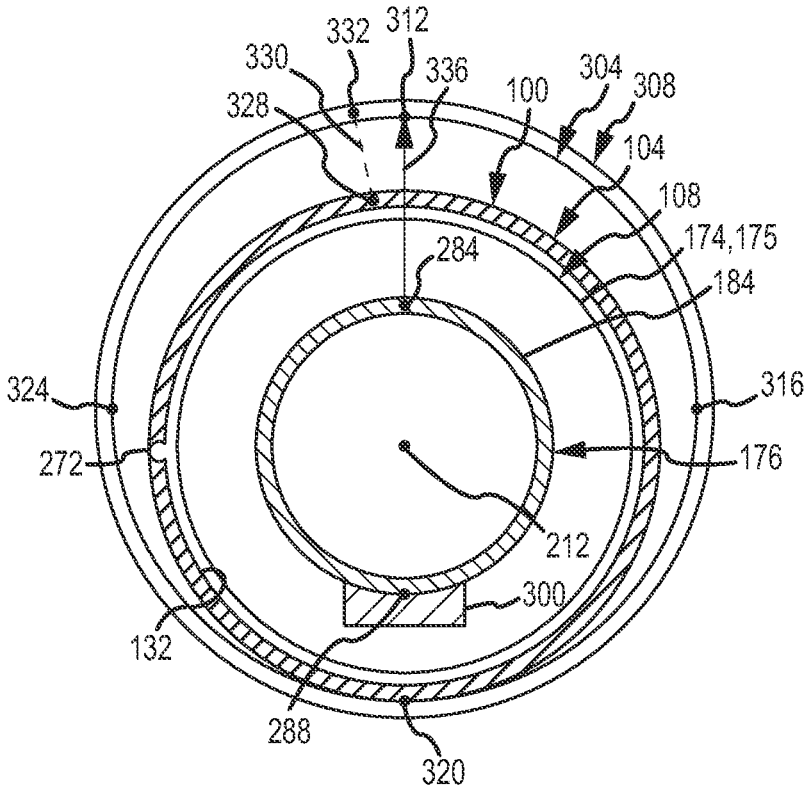
FIG. 9 illustrates a sectional view of the perforating gun of FIG. 1 being disposed within a wellbore and the tubular barrel being positioned in a first orientation.
Figure 10:
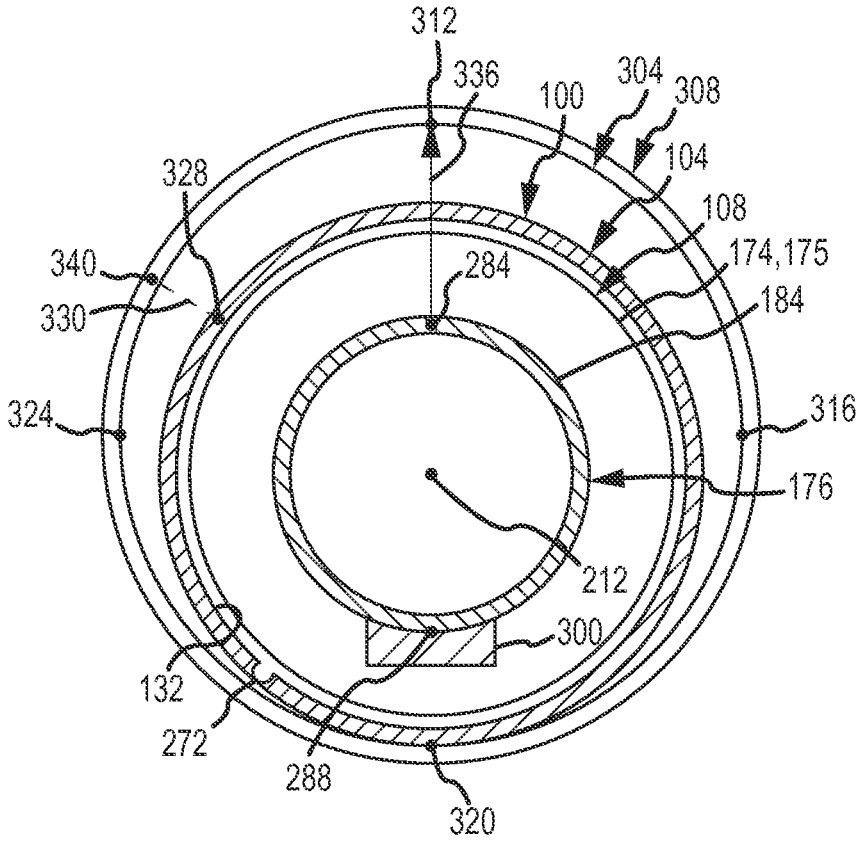
FIG. 10 illustrates a sectional view of the perforating gun of FIG. 1 being disposed within a wellbore and the tubular barrel being positioned in a second orientation.

As discussed herein, the charge holding structure 176 is operable to orient itself in a desired position regardless of a position of the tubular barrel 104 and the end caps 174, 175. Turning now to FIGS. 6, 9 and 10 (the wiring tube 252, bearing structures 216, etc. have been removed for clarity), first and second substantially straight reference lines 284, 288 may be defined along an outer or exterior surface 292 of the tubular housing 184 between the first and second ends 188, 192 such that a reference plane 296 is defined that runs through or intersects both of the first and second reference lines 284, 288. It should be noted that the first and second reference line 284, 288 (and other reference lines) need not necessarily be visibly defined on the exterior surface 292, although doing so may assist a manufacturer in locating charge openings through the tubular housing 184 for reasons that will become apparent below. As used herein, a substantially "straight" line may signify a line that follows substantially a single axis (e.g., an "x" axis as in FIG. 6) and is free of bends, curves, etc. with respect to the single axis. In any event, a mass (or weight) of the charge holding structure 176 and/or tubular housing 184 near or in the vicinity of the second reference line 288 may be greater than a mass (or weight) of the charge holding structure 176 and/or tubular housing 184 near or in the vicinity of the first reference line 284. In one arrangement, one or more weights 300 of any appropriate mass may be disposed near or adjacent the second reference line 288 (e.g., on the inside or outside of the tubular housing 184). In another arrangement, the charge holding structure 176 or tubular housing 184 may be manufactured so as to have an increased mass in the vicinity of the second reference line 288 relative to in the vicinity of the first reference line 284.

When at least one of the first and second end caps 174, 175 is fixed relative to the charge holding structure 176, the increased mass of the charge holding structure 176 near the second reference line 288 may work in conjunction with gravity to create a moment about the rotational axis 212 that rotates the charge holding structure 176 to the position shown in FIG. 6 (assuming the charge holding structure 176 is initially in a different rotational position from that shown in FIG. 6) upon overcoming any friction that exists in the bearing structure 216 and/or associated with the rotational axis 212. By virtue of this arrangement, the second reference line 288 may be always or substantially always operable to face downwardly (e.g., towards the bottom of a circumferential portion of the interior surface of a wellbore casing, towards a 180° phase angle on interior surface of the wellbore casing, towards the center of the earth).

Moreover, the first reference line 284 may be defined on a portion of the exterior surface 292 of the charge holding structure 176 at a position that is opposite or opposed (e.g., 180°) from the second reference line 288 (as in FIG. 6). As a result, the first reference line 284 may always or substantially always be operable to face upwardly (e.g., towards the top of a circumferential portion of the interior surface of a wellbore casing, towards a 0° phase angle on interior surface of the wellbore casing, away from the center of the earth) and the reference plane 296 may always or substantially always become parallel to and/or coincident with a vertical plane when one or both of the first and second end caps 174, 175 are fixed in relation to the charge holding structure 176. When one or more first charge openings 200 are formed through the tubular housing 184 such that the first reference line 284 extends through such first charge openings 200 (e.g., through the center of the first charge openings 200, see FIG. 6), the increased mass of the charge holding structure 176 near the second reference line 288 is operable to cause the first charge openings 200 to face at least substantially upwardly or towards the 0° phase angle on the interior surface of a wellbore casing regardless of a position of the first and second end caps 174, 175, tubular barrel 104, etc. Thus, and with reference to FIG. 6, the explosive charge(s) 180 may be operable to contact the top of the interior surface of the wellbore casing (i.e., at a 0° phase angle) assuming the explosive charge 180 is mounted on or within the charge holding structure 176 such that when ignited, the explosive charge(s) 180 follow a firing path 306 that is parallel or substantially parallel to the reference plane 296 and/or the axis 208. As discussed previously, perforating or puncturing the casing at a 0° and/or 180° phase (i.e., at the top and/or bottom of the wellbore) is advantageous as doing so may show more open perforations during the fracing process. Numerous other reference lines with or without reference planes extending therethrough may be defined on the charge holding structure 176 which may allow other phase angles on the wellbore casing to be perforated.

FIGS. 9-10 are cross-sectional views of a perforating gun 100 (including the charge assembly 108 being disposed within the internal cavity 128 of the tubular 104 as discussed previously) disposed within a wellbore 304 including a wellbore casing 308 at two different circumferential positions in relation to the wellbore casing 308. While not shown, it is also contemplated that the perforating gun 100 may be utilized in conjunction with wellbores not having linings or casings disposed about an interior surface thereof. In any event, and as seen, 0°, 90°, 180° and 270° phase angle locations 312, 316, 320, 324 have been provided for reference (although the perforating gun 100 may also be used to perforate numerous other phase angle locations between 0° and 360°). As discussed herein, the charge holding structure 176 may "automatically" orient itself as discussed above in relation to the wellbore casing 308 substantially regardless to an inclination, curvature, shape, path, etc. of the wellbore 304, orientation of the tubular barrel 104, the first and second end caps 174, 175, etc. That is, the first reference line 284 (and/or a portion of the charge holding structure 176 generally opposed to the portion with an increased mass) and any first charge openings 200 having the first reference line 284 running therethrough may almost always being oriented towards the 0° phase angle location 312 (i.e., the top of the interior surface of the wellbore casing 308).

With initial reference to FIG. 9, a firing direction 336 of an explosive charge extends generally perpendicularly away from the first reference line 284 and towards the 0° phase angle location 312 (e.g., when the explosive charge is mounted relative to the second reference line 288 to fire towards the first reference line 284), and a reference line 330 extending perpendicularly away from a reference location 328 on the tubular barrel intersects a first location 332 on the interior surface of the wellbore casing 308. Turning to FIG. 10 and after the tubular barrel 104 has been rotated or otherwise positioned at a different rotational position within the wellbore 308, the reference line 330 is now directed towards a second location 340 on the interior surface of the wellbore casing, but the firing direction 336 is still oriented towards the 0° phase angle location 312 due to the structure disclosed herein. As a result, operators may be more confident in knowing that a particular circumferential location on the wellbore casing 308 (e.g., the 0° phase angle location 312) or location near the particular circumferential location has been perforated regardless of an orientation of the tubular barrel 104.

The perforating gun 100 may be utilized in a wellbore 304 of almost any shape, orientation, etc. (e.g., substantially vertical to completely horizontal) to achieve the above-discussed "automatic" orientation of the charge holding structure 176 (and explosive charges contained therein or associated therewith). Furthermore, explosive charges may be designed to fire through openings other than the first charge openings 200. For instance, explosive charges may be designed to fire through or relative to one or more second charge openings 204 (e.g., being of the shape of the first charge openings 200 shown in FIG. 4) such that such explosive charges may be oriented to fire near or directly at the 180° phase angle location 320 in FIGS. 9-10 (i.e., the bottom of the wellbore case 308). It may be beneficial to space the weights 300 from such second charge openings 204 so as to avoid interference with the explosive charges. In one embodiment, explosive charges may be mounted relative to the charge holding structure 176 so as to fire towards both the 0° and 180° phase angle locations 312, 320 in any appropriate arrangement.

In other arrangements, explosive charges may additionally or alternatively be mounted in or relative to the charge holding structure 176 or tubular housing 184 so as to fire along fire directions that are towards other circumferential locations on the wellbore casing 308. For instance, explosive charges may be mounted so as to fire towards the 90° and/or 270° phase angle locations 316, 324 on the wellbore casing 208. The direction that an explosive charge should fire away from the charge holding structure 176 so as to contact a desired circumferential location on the wellbore casing 308 (for locations other than the 0° and 180° phase angle locations 312, 320) may be readily determined before the perforating gun 100 has been conveyed into the wellbore 304 based on the inner diameter of the wellbore casing 308, the outer diameter of the tubular barrel 104, the position of the charge holding structure 176 relative to the tubular barrel 104, etc.

As discussed previously, the charge holding structure 176 does not need to be in the form of a tubular housing 184 having an internal cavity 196 into which explosive charges may be loaded. For instance, in the case of the charge holding structure 176 being in the form of a bar or other similar structure, a portion of the bar could have an increased mass compared to an opposed or different part of the bar as discussed above such that a second reference line passing through or near such increased mass portion may be operable to face towards a bottom of the wellbore casing and a first reference line passing through the opposed or different part of the bar may be operable to face towards a top of the wellbore casing. In this regard, explosive charges that are mounted on or associated with the bar so as to fire directly away from the first reference line (e.g., perpendicularly from the top surface of the bar) may be operable to always or substantially always fire towards the 0° phase angle location on the interior surface of the wellbore casing due to the increased mass near the second reference line, gravity, etc. Other circumferential locations on the wellbore casing may also be perforated as discussed above. Regardless of the specific structure or form of the charge holding structure 176, the charge holding structure 176 may be designed as discussed herein to always or substantially always assume the same or similar position regardless of an orientation of the tubular barrel, shape and orientation of the wellbore, position of the end caps, etc.

The charge assembly 108 may be designed and constructed to be used with standard sized tubular barrels (e.g., 3⅛" diameter) in addition to tubular barrels of other sizes (e.g., 3⅜" diameter, other sizes). Moreover, any of the charge assemblies or apparatuses disclosed herein may be used as part of methods for use in perforating casing of wellbores that pass through subterranean foundations. For instance, any of the charge assemblies may be inserted into a tubular barrel so as to collectively define a perforating un, the perforating gun may be appropriately sent or conveyed into or down a wellbore (e.g., via a tubing conveyed or wireline manner), and charges may be fired from the perforating gun to perforating the wellbore casing.

Figure 11:
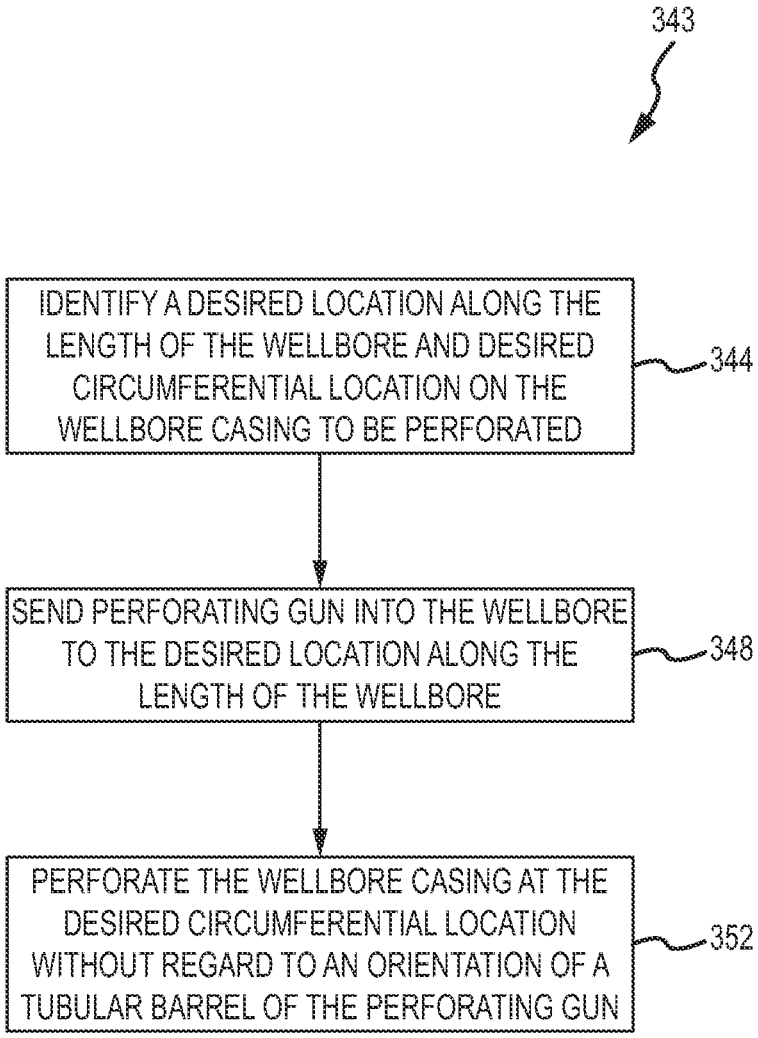
FIG. 11 illustrates a flow diagram showing a method for use in perforating a wellbore casing.

Turning to FIG. 11, another method 343 for use in perforating a casing of a wellbore that passes through a subterranean formation may include identifying 344 a desired location along the length of the wellbore and/or a desired circumferential location on the wellbore casing to be perforated. Operators, geologists and the like can determine appropriate locations to be perforated depending upon the subterranean structure, the type of substance to be extracted, etc. The method also includes sending 348 a perforating gun into the wellbore from an entry point to the desired longitudinal location with respect to a length of the wellbore. For instance, the perforating gun may include any of those perforating guns disclosed herein (e.g., including a tubular barrel with a charge holding structure having one or more explosive charges rotatable received therewithin). This step may include any appropriate perforating method such as tubing conveyed, wireline, and the like. Thereafter, the method may include perforating 352 the wellbore casing at the desired circumferential location using the one or more explosive charges regardless of an orientation of the tubular barrel of the perforating gun. That is, even as the tubular barrel rotates or twists while being conveyed down the wellbore, the desired circumferential location may still be perforated.

In one arrangement, the sending may include orienting a firing direction of the at least one charge at the desired circumferential location during substantially the entire length of the wellbore between the entry point and the desired longitudinal location. For instance, the wellbore may change direction at least once between the entry point and the desired longitudinal location as part of the sending. In another arrangement, a plane passing through the desired circumferential location and an opposite circumferential location on the wellbore casing that is spaced 180° from the desired circumferential location substantially coincides with a vertical plane as discussed previously. For instance, the desired circumferential location includes a first desired circumferential location and the opposite circumferential location includes a second desired circumferential location, where the perforating step further includes perforating the wellbore casing at the second desired circumferential location using at least one charge contained within the perforating gun. In one arrangement, the desired longitudinal location is contained within a substantially horizontal portion of the wellbore.

Of course, a perforating gun may include multiple perforating gun portions which may be appropriately interconnected as discussed above (e.g., via connecting subs) to obtain a perforating gun of a desired length. Additionally, successive perforating gun portions may be fired as is known depending upon the particular type of perforating being performed. For instance, in the case of a tubing conveyed perforating scenario, the amount of time between the ignition of the charges in adjacent perforating gun portions may be set (e.g., 6 minutes). In this regard, when an operator needs to move the next perforating gun portion to fire to a different location within the wellbore, the operator would need to do so within the set time. In the case of a wireline perforating scenario, the operator can selectively fire successive perforating gun portions at any desired time by alternatively sending positive and negative currents through the perforating gun. More specifically, if the most recent perforating gun portion to fire utilized a positive current, the next adjacent perforating gun portion would fire by sending a negative current down the perforating gun. The various wiring paths discussed herein (e.g., wiring tube 252, elongated channel 272 in the tubular barrel) advantageously allow the construction of perforating guns having a greater number of perforating gun portions (each of which can be selectively fired) due to the ability of such wiring paths to limit twisting, binding, damage, etc. to the various wires, cables, and the like that are required to ignite the various explosive charges.

The foregoing description has been presented for purposes of illustration and description. Furthermore, the description is not intended to limit the invention to the form disclosed herein. Consequently, variations and modifications commensurate with the above teachings, and skill and knowledge of the relevant art, are within the scope of the disclosure herein. The embodiments described hereinabove are further intended to explain best modes known of practicing the invention and to enable others skilled in the art to utilize the invention in such, or other embodiments and with various modifications required by the particular application(s) or use(s) of the invention. It is intended that the appended claims be construed to include alternative embodiments to the extent permitted by the prior art.

What is claimed is:

1. An apparatus for use in perforating a wellbore casing, comprising:

a tubular housing including a first end, a second end, and an internal cavity between the first and second ends, wherein the internal cavity is adapted to contain at least one perforating charge;

a first end cap that is positionable generally adjacent the first end of the tubular housing;

a second end cap that is positionable generally adjacent the second end of the tubular housing, wherein the first and second end caps are respectively interconnectable to the first and second ends of the tubular housing such that the tubular housing is rotatable relative to the first and second end caps;

a first bearing structure positionable generally adjacent the first end of the tubular housing, the first bearing structure including a first portion that is non-movably interconnectable to the tubular housing and a second portion that is non-movably interconnectable to the first end cap;

a second bearing structure positionable generally adjacent the second end of the tubular housing, the second bearing structure including a first portion that is non-movably interconnectable to the tubular housing and a second portion that is non-movably interconnectable to the second end cap;

a stub extending away from a first surface of each of the first and second end caps, wherein the stub of the first end cap is receivable within a bore of the first bearing structure and the stub of the second end cap is receivable within a bore of the second bearing structure;

a first substantially straight reference line defined along an outer surface of the tubular housing and extending between the first and second end caps;

a second substantially straight reference line defined along an outer surface of the tubular housing and extending between the first and second end caps; and a reference plane defined through the first and second reference lines, wherein the first and second end caps are respectively interconnectable to the first and second ends of the tubular housing such that the reference plane remains in a particular orientation regardless of an orientation of either of the first and second end caps when the apparatus is disposed in a wellbore.

2. The apparatus of claim 1, wherein a central axis of each of the first and second end caps is spaced from and substantially parallel to a central axis of the tubular housing.

3. The apparatus of claim 1, wherein a mass of the apparatus adjacent the second reference line is greater than a mass of the apparatus adjacent the first reference line, wherein the first and second end caps are respectively interconnectable to the first and second ends of the tubular housing such that the first reference line faces generally away from the center of the earth and the second reference line faces generally towards the center of the earth regardless of an orientation of either of the first and second end caps.

4. The apparatus of claim 3, wherein at least one weight is disposed on the tubular housing adjacent the second reference line.

5. The apparatus of claim 3, wherein at least one first charge opening is disposed through the tubular housing for receiving a perforating charge.

6. The apparatus of claim 5, wherein one of the first and second reference lines intersects the at least one first charge opening.

7. The apparatus of claim 6, wherein the other of the first and second reference lines intersects at least one second charge opening.

8. The apparatus of claim 5, further comprising:

a third substantially straight reference line defined along an outer surface of the tubular housing and extending between the first and second end caps, the third reference line being spaced from the first and second reference lines, wherein the third reference line intersects the at least one first charge opening.

9. The apparatus of claim 1, wherein the particular orientation coincides with a vertical plane.

10. The apparatus of claim 1, further comprising:

a charge mounted relative to the tubular housing.

11. The apparatus of claim 1, further comprising:

a tubular barrel comprising an internal cavity, wherein the first end cap, second end cap and tubular housing collectively comprise a charge assembly, and wherein the internal cavity of the tubular barrel is adapted to receive the charge assembly.

12. The apparatus of claim 11, wherein the first and second end caps are non-rotatably interconnectable to the tubular barrel, and wherein the tubular housing is rotatable relative to the tubular barrel.

13. The apparatus of claim 12, further comprising:

a first locking structure mountable within the internal cavity of the tubular barrel to an inside surface of the tubular barrel adjacent the first end cap of the charge assembly; and a second locking structure mountable within the internal cavity of the tubular barrel to an inside surface of the tubular barrel adjacent the second end cap of the charge assembly, wherein the first and second locking structures are operable to restrict motion of the charge assembly along a length of the tubular barrel.

14. The apparatus of claim 12, further comprising:

a sub interconnectable to at least one of the first and second ends of the tubular barrel, the sub including a first end, a second end, and at least one internal cavity between the first and second ends.

15. The apparatus of claim 14, further comprising:

a wiring tube that is interconnectable to the first and second end caps, wherein the at least one internal cavity of the sub is adapted to receive a wire or cord passed from the wiring tube.

16. The apparatus of claim 14, wherein the tubular barrel and charge assembly collectively comprise a first perforating gun portion, and wherein the apparatus further comprises:

a second perforating gun portion, wherein the first end of the sub is interconnected to the tubular barrel of the first perforating gun portion and the second end of the sub is interconnected to the tubular barrel of the second perforating gun portion.

17. An apparatus for use in perforating a wellbore casing, comprising:

a tubular housing including a first end, a second end, and an internal cavity between the first and second ends, wherein the internal cavity is adapted to contain at least one perforating charge;

a first end cap that is positionable generally adjacent the first end of the tubular housing;

a second end cap that is positionable generally adjacent the second end of the tubular housing;

a first substantially straight reference line defined along an outer surface of the tubular housing and extending between the first and second end caps;

a second substantially straight reference line defined along an outer surface of the tubular housing and extending between the first and second end caps;

a reference plane defined through the first and second reference lines, wherein the first and second end caps are respectively interconnectable to the first and second ends of the tubular housing such that the reference plane remains in a particular orientation regardless of an orientation of either of the first and second end caps when the apparatus is disposed in a wellbore; and a wiring tube that is interconnectable to the first and second end caps, wherein the tubular housing is movable relative to the wiring tube.

18. The apparatus of claim 17, further comprising at least one spacer disposed about the tubular housing for spacing the wiring tube from the tubular housing.

19. The apparatus of claim 17, wherein each of the first and second end caps comprises an opening extending through a surface thereof for respectively receiving a first or second end of the wiring tube.

20. An apparatus for use in perforating a wellbore casing, comprising:

a tubular housing including a first end, a second end, and an internal cavity between the first and second ends, wherein the internal cavity is adapted to contain at least one perforating charge;

a first end cap that is positionable generally adjacent the first end of the tubular housing;

a second end cap that is positionable generally adjacent the second end of the tubular housing;

a tubular barrel comprising an internal cavity, wherein the first end cap, second end cap and tubular housing collectively comprise a charge assembly, wherein the internal cavity of the tubular barrel is adapted to receive the charge assembly, wherein the first and second end caps are non- rotatably interconnectable to the tubular barrel, and wherein the tubular housing is rotatable relative to the tubular barrel;

a first locking structure mountable within the internal cavity of the tubular barrel to an inside surface of the tubular barrel adjacent the first end cap of the charge assembly;

a second locking structure mountable within the internal cavity of the tubular barrel to an inside surface of the tubular barrel adjacent the second end cap of the charge assembly, wherein the first and second locking structures are operable to restrict motion of the charge assembly along a length of the tubular barrel, wherein each of the first and second end caps comprises a first engagement structure and each of the first and second locking structures comprises a second engagement structure, wherein the first engagement structures of the first and second end caps are respectively engageable with the second engagement structures of the first and second locking structures to restrict respective rotation between the first and second end caps and the first and second locking structures;

a first substantially straight reference line defined along an outer surface of the tubular housing and extending between the first and second end caps;

a second substantially straight reference line defined along an outer surface of the tubular housing and extending between the first and second end caps; and a reference plane defined through the first and second reference lines, wherein the first and second end caps are respectively interconnectable to the first and second ends of the tubular housing such that the reference plane remains in a particular orientation regardless of an orientation of either of the first and second end caps when the apparatus is disposed in a wellbore.

21. The apparatus of claim 20, wherein one of the first and second engagement structures comprise pegs and other of the first and second engagement structures comprise apertures that receive the pegs.

22. A method for use in perforating a casing of a wellbore that passes through a subterranean formation, the method utilizing a perforating gun that comprises the tubular barrel and charge assembly of claim 11, the method comprising:

sending the perforating gun into the wellbore; and firing charges from the perforating gun to perforate the wellbore casing.

* * * * *

UNITED STATES PATENT AND TRADEMARK OFFICE

CERTIFICATE OF CORRECTION

PATENT NO. : 8,443,886 B2
APPLICATION NO. : 12/955741
DATED : May 21, 2013
INVENTOR(S) : Manuel Torres et al.

It is certified that error appears in the above-identified patent and that said Letters Patent is hereby corrected as shown below:

Patent Title page, Item (74), delete "Szummy" and insert therefor --Szumny--

Signed and Sealed this
Third Day of September, 2013

Teresa Stanek Rea
*Acting Director of the United States Patent and Trademark Office*